US005107958A

United States Patent [19]

Johnson

[11] Patent Number: 5,107,958

[45] Date of Patent: Apr. 28, 1992

[54] LADDER LEVELER

[76] Inventor: Robert L. Johnson, Box 568-10, Wallingford, Vt. 05773

[21] Appl. No.: 552,483

[22] Filed: Jul. 16, 1990

[51] Int. Cl.[5] ..... E06C 7/44

[52] U.S. Cl. ..... 182/204; 182/109; 182/111

[58] Field of Search ..... 182/204, 205, 111, 107, 182/109, 203

[56] References Cited

U.S. PATENT DOCUMENTS

| | | | |
|---|---|---|---|
| 1,157,739 | 10/1915 | Tyler | 182/204 |
| 2,783,928 | 3/1957 | Cox | 182/203 |
| 3,165,170 | 1/1965 | Blaney | 182/203 |
| 3,861,500 | 1/1975 | Dempsey | 182/204 |
| 3,882,966 | 5/1975 | Fasano | 182/205 |
| 4,423,797 | 1/1984 | Batten | 182/204 |

FOREIGN PATENT DOCUMENTS

| | | | |
|---|---|---|---|
| 170199 | of 1921 | United Kingdom | 182/205 |

*Primary Examiner*—Reinaldo P. Machado
*Attorney, Agent, or Firm*—John J. Welch, Jr.

[57] ABSTRACT

A Johnson Ladder Leveler serving to level a ladder on an uneven surface comprising an extension leg held by a bolt nut apparatus to a treaded triangular foot which said extension leg extends longitudinally when in use while fastened by way of a spring pin head on a spring pin welded to said extension's leg's medial side and by way of a threaded screw bolt from without to a ladder receiving sleeve via insertion into said ladder receiving sleeve's outermost of two compartments while said ladder receiving sleeve internally holds an internally mounted ladder leg within the innermost of said ladder receiving sleeve's said two compartments.

2 Claims, 3 Drawing Sheets

LADDER LEVELER

BACKGROUND OF THE INVENTION

1. The Field of Invention

Figure 1:
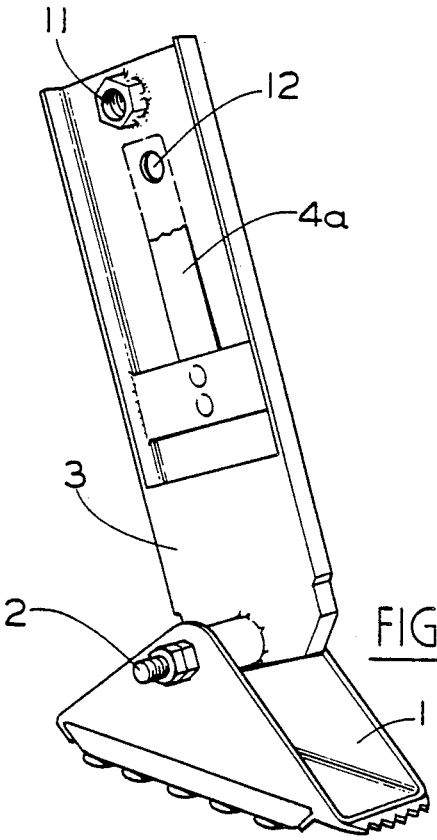

The instant invention pertains to devices such as would be helpful in respect of serving to stabilize ladders used by workmen in places where base ground or flooring is not level from side to side. It also serves to stabilize such ladders so as to prevent them from sliding away and out from initial positions of inclination on base surfaces that would be hard and relatively frictionless. This device serves to enhance safety in the use of ladders, an unquestionably desirable goal.

2. A Description of Possible Prior Art

The inventor is aware of a number of references cited below that refer to inventions meant to serve as ladder levelers of sorts.

Citations

| | Inventor | Invention | Patent No. | Date |
|---|---|---|---|---|
| 1. | Veness | Ladder Extension Device | 4,844,208 | 7/4/89 |
| 2. | Cordell | Leveler Attachment for Ladders | 4,802,471 | 2/7/89 |
| 3. | Wallick, Jr. | Ladder Leg Extender and Leveler | 4,766,976 | 8/30/88 |
| 4. | Baker | Ladder Leveler Apparatus | 4,683,982 | 8/4/87 |
| 5. | Murphy | Ladder Leveling Apparatus | 4,683,983 | 8/4/87 |
| 6. | Belt | Adjustable Ladder Leg | 4,606,432 | 8/19/86 |
| 7. | Batten | Ladder Leveling Device | 4,423,797 | 1/3/84 |
| 8. | Fernadez | Ladder Extension Apparatus | 4,249,638 | 2/10/81 |
| 9. | Davis, et al | Ladder Extension | 4,607,726 | 8/26/86 |
| 10. | Larson, et al | Extension Ladder with Ladder Leveler Means | 3,948,352 | 4/6/76 |

Comments

Virtually all of the above-referenced devices are co-called externally mounted devices exclusively. The instant device is however much different in that it is an internally mounted device. With all of the other externally mounted devices, improper tightening of fastener components could result in slippage and concomitant disaster. However, with the instant device due to internal mounting, such slippage can never take place. Moreover, to the extent that certain of the other devices could be viewed as serving as internally mounting devices, nevertheless; such of those devices as could be so viewed, are comprised of many more components than the instant device and are consequently much more expensive to repair and maintain. Hence, the instant device, respectfully submitted is new providing for internal mounting directly; useful as serving to satisfy a definite need at many worksites and unique insomuch as it maximizes safety while minimizing the expense of manufacture, maintenance and of the time needed to adjust a leveler securely, to wit, time better spent by a workman actually on the job doing what has to be done as contracted for.

A SUMMARY OF THE INVENTION

1. A Brief Description of the Invention

The instant invention consists of a treaded triangular foot for surface traction. The said foot is attached to an extension leg by way of bolt-nut arrangement that inserts through the apices of the front and back triangular aspects of said foot. Said foot is also characterized by the presence of metallic teeth at one end for biting into a surface for additional traction. The said extension leg is characterized by the presence of an internally mounted spring-pin the head of which fits through a first hole in said leg. The said leg also has just above said first hole a second bossed hole through which a threaded screw bolt can be inserted from without. The said spring pin head and said screw bolt serve to effect tightening of said leg to the lateral aspect of a ladder receiving sleeve characterized by the presence of a number of holes on its lateral side spaced so as to receive said spring pin head and said screw bolt at the same time at various heights up or down said sleeve. Also, the front and back sides of said sleeve have three (3) screw holes through which screws can be threaded to permanently internally mount a ladder leg. Moreover, said sleeve is characterized by the presence of an internal compartment as high and as deep as the said sleeve, which internal compartment designed to receive a ladder leg internally, has at its base a load bar serving to support the bottom face of a ladder leg. Finally, said sleeve has an external compartment which serves to receive said extension leg. The said compartment is separated by one continuous wall. Spot welded wire holds the said threaded screw bolt to said extension sleeve and likewise serves to hold said extension sleeve via said base load bar to said bolt-spring apparatus when the instant device is not in use with respect to holding an internally mounted ladder leg. When the extension leg of one device to which one a ladder's legs has been internally mounted is extended and held by said threaded screw bolt and said spring pin head within said sleeve's said external compartment longitudinally moreso that the extension of a leg similarly held of a second device to which said ladder's other leg has been internally mounted, then, its possible for work on a ladder above ground sloping from side to side or on stair treads to be done as though said ladder were on level ground or a level surface.

2. The Object of the Invention

The object of this invention is to provide the sturdy, secure, safe and relatively inexpensive leveling of a ladder in workplaces characterized by uneven side to side surfaces such as sloping land or adjacent stair treads. Also it is intended to provide maximal biting traction on surfaces so as to maximally prevent slippage of a ladder at its base out and away from the base of the workwall. This invention characterized by the simplicity of its elementary component in combination with one another accomplishes by way of internal mounting; thereby obviating the need for interim tightening, such sturdy and secure leveling and traction as would provide the utmost in safety to any ladder user. Also, by virtue of its essential simplicity, it is inherently much less expensive to manufacture and maintain that other related devices. In short, respectfully submitted, this device is new, unquestionably useful and unique by virtue of its mode of internal mounting and is a vast improvement over related devices by virtue of its inherent relative simplicity and concomitantly relative inherent economy of manufacture and maintenance not to mention maximal safety to use.

A BRIEF DESCRIPTION OF THE DRAWINGS

FIG. 1 is a side view of the device's triangular foot with tread and toe teeth along with the device's bolt nut apparatus serving to affix said foot to the device's extension leg (here the medial aspect is shown) with its internally mounted spring pin and first hole just above said spring pin to receive the head of said spring pin and below a bossed second hole to receive a threaded screw bolt from without.

Figure 2:
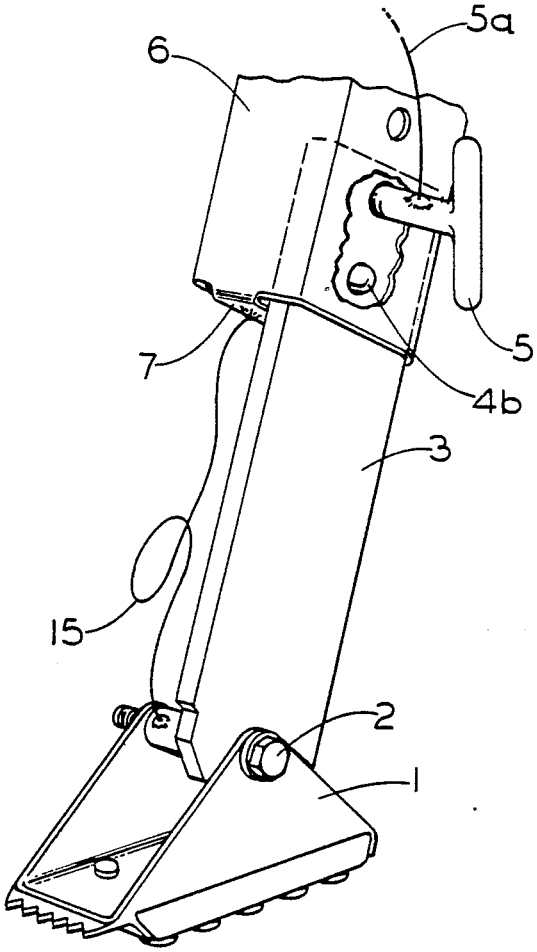

FIG. 2 is another side view of the device's triangular foot with tread and toe teeth along with the device's bolt nut apparatus serving to affix said triangular foot to the said extension leg (here the lateral of the said extension leg is shown) along with the head of said internally mounted spring pin protruding through said first hole and said threaded screw bolt entering said bossed second hole from without. Also evident is a cut away of the device's receiving sleeve as well as wire affixed to said threaded screw bolt. Said wire affixed to the bottom of the base load bar of said sleeve and to the exterior of said bolt-nut apparatus is also evident.

Figure 3:
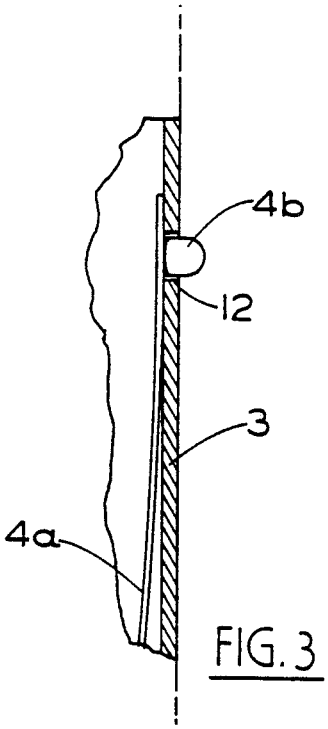

FIG. 3 is a lateral view of said internally mounted spring pin with said head of said spring pin protruding through said first hole of said extension leg.

Figure 4:
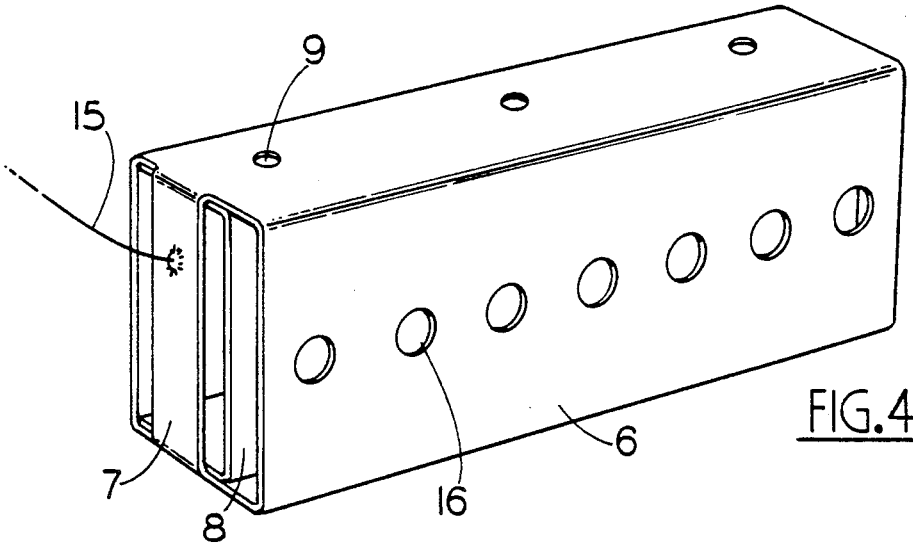

FIG. 4 is a side view of the device's said receiving sleeve showing its frontal aspect characterized by three (3) screw holes, its lateral aspect characterized by seven (7) holes for receipt of said spring pin's head through the said leg's said first hole and for threading from without with said threaded screw bolt through to and into said leg's second bossed hole and said sleeve's base plate load bar for holding the base of a leg of a ladder screwed to said receiving sleeve via screws through said three (3) screw holes in the frontal aspect of said sleeve. The lateral wall of said sleeve's internal compartment is also apparent.

Figure 5:
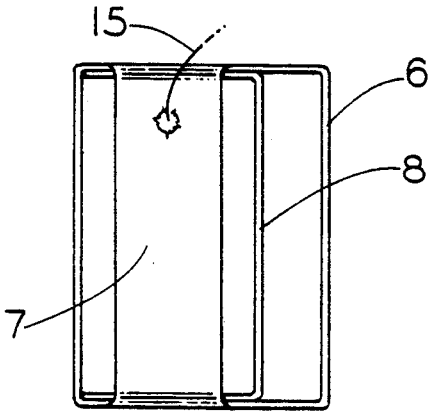

FIG. 5 is a bottom view of said receiving sleeve and said sleeve's said baseplate load bar. Also evident are said sleeve's said internal compartment and the base of said lateral wall of said internal compartment. Wire as aforesaid affixed to the bottom of said load bar is also evident. Said sleeve's said external compartment is also evident.

Figure 6:
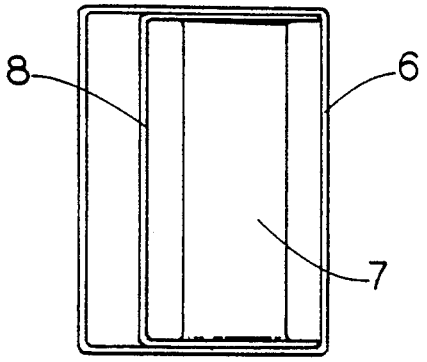

FIG. 6 is a top view of said sleeve and said sleeve's said base plate load bar showing as well the top of the said lateral wall of its said internal compartment. The said internal and external compartments of said sleeve are also evident.

Figure 7:
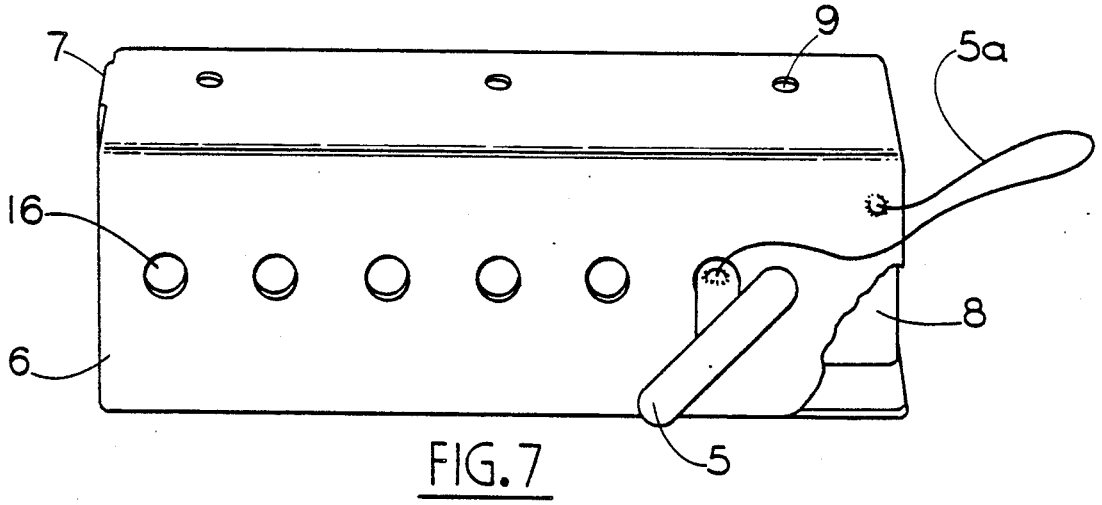

FIG. 7 is a side view of said sleeve showing its anterior aspect characterized by three (3) screw holes, its lateral aspect characterized by seven (7) holes, said threaded screw bolt received from without by one of said seven (7) holes, wires spotwelded to said threaded screw bolt and the lateral aspect of said sleeve, and a cutaway view of the said lateral wall of said sleeve's said internal compartment.

Figure 8:
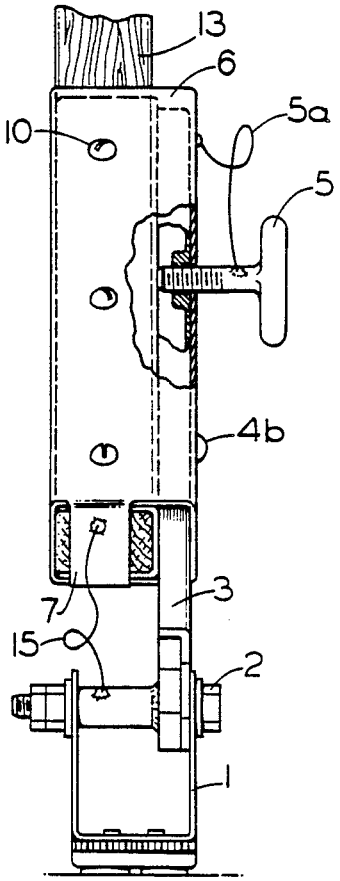

FIG. 8 is a frontal view of the instant device intact with its said extension leg, bolt nut apparatus and triangular foot and said device's said receiving sleeve held together by the said head of said threaded screw bolt and the right leg of a ladder screwed to said sleeve via screws through its said three (3) frontal screw holes. Also evident is said sleeve's said base load bar. Wire affixed to said sleeve's said load bar and said device's said bolt-nut apparatus is also evident.

Figure 9:
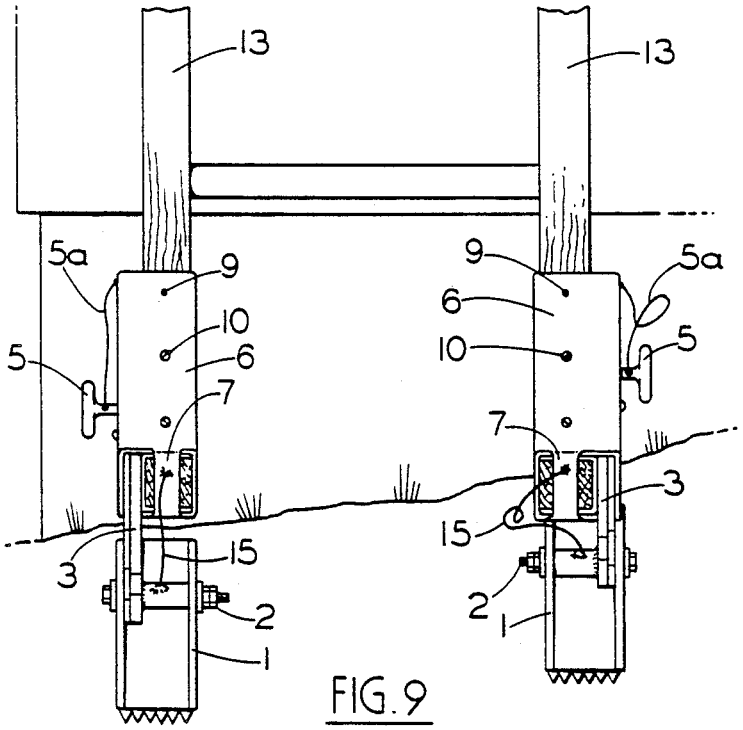

FIG. 9 is a view of instant devices mounted to the right and left legs respectively of a ladder.

Figure 10:
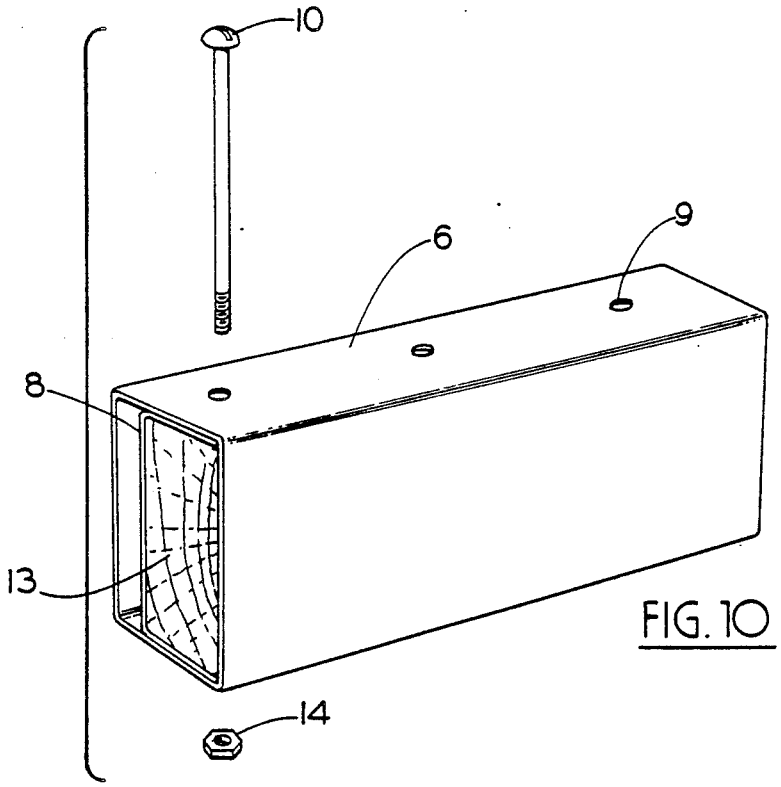

FIG. 10 is a side view of the device's said sleeve showing its frontal aspect characterized by three (3) screw holes, its medical aspect and the top side of said sleeve. The top part of the said lateral wall of said sleeve's said internal compartment, and said sleeve's said internal and said external compartments are also evident. Also, bolts (one shown) for holding screws screwed through each of three (3) holes in the frontal aspect, to wit, the anterior face of said sleeve, as shown in FIG. 8 screwed through a ladder leg as also shown in FIG. 8 and out through each of three (3) correlative holes as would be seen in the posterior side of said sleeve are shown.

A DESCRIPTION OF THE PREFERRED EMBODIMENT

The instant invention is described as follows:

Threaded triangular foot (1) is characterized by the presence of sawtooth toes for biting into an earthen surface. Threaded triangular foot (1) is attached to Extension leg (3) by means of bolt nut apparatus (2). Affixed to the interior aspect of Extension leg (3) is Spring pin (**4*a*) characterized by the presence of a Spring pin head (4*b*) that protrudes through a First hole (12) in Extension leg (3). Extension leg (3) has a bossed Second hole (11) just above said First hole (12) through which Threaded screw bolt (5**) can be screwed from without.

Threaded screw bolt (5) functions along with said Spring pin head (**4*b*) to hold Ladder receiving sleeve (6) firmly in apposition to Extension leg (3). Ladder receiving sleeve (6) is screwed to the leg (13) of a ladder by way of three Holes (9) for receiving Screws (10) on its anterior side, which Screws (10) pass into a ladder's leg anteriorly, through it and out its posterior side and through three more holes in the posterior side of Ladder receiving sleeve (6) where Bolts (14) are then put on said Screws (10) to thereby internally mount Ladder leg (13) permanently within Ladder receiving sleeve (6). Ladder receiving sleeve (6) is characterized by the presence of two compartments. The internal one of said two compartments contains the internally mounted leg of said ladder which rests at its bottom with its bottom edge lying flat against Load bar (7) which is the base of said Ladder receiving sleeve's said internal compartment. Load bar (7) functions to, along with the above-said internal mounting, facilitate even further non-slippage of a mounted ladder. The later most or external one of the said two compartments of said Ladder receiving sleeve (6) serves to receive Extension leg (3) which is held in situ by the head (4*b*) of Spring Pin (4*a*) protruding out from within through said First hole (12) of said Extension leg (3) and concomitantly through one of the holes in the lateral side of Ladder receiving sleeve (6) and likewise so held by Threaded screw bolt (5) which is screwed from without into a hole in the lateral side of Ladder receiving sleeve (6) just above the hole therein through which the head (4*b*) of Spring Pin (4*a*) would be protruding. Said Threaded screw bolt (5) concomitantly is received by the said bossed Second hole (11) in said Extension leg (3). The said Ladder receiving sleeve's (6) said two compartments are separated by lateral wall (8) of said sleeve's said internal compartment. Threaded screw bolt (5) is held to the lateral side of Ladder receiving sleeve (6) by a sturdy piece of flexible wire (5*a*) welded to its tip and said Ladder receiving sleeve's (6) external lateral side which prevents said Threaded screw bolt (5) from being lost or separated from the rest of the invention at times when it might not, for whatever reason, be screwed into place. Finally, a sturdy piece of flexible Wire (15) is welded to the bottom face of said Base load bar (7) and to the external aspect of Bolt-nut apparatus (2) serving to prevent said Extension leg (3) from being separated from said Ladder receiving sleeve (6**) when the instant device is not being used to support the leg of a ladder.

What is claimed is:

1. A Ladder Leveler, comprising:

a) a treaded triangular foot;

b) an extension leg capable of longitudinal extension;

c) a bolt-nut apparatus for holding said triangular foot and said extension leg together;

d) a ladder receiving sleeve with an internal compartment separated by a wall running the height of the sleeve from an external compartment;

e) a spring pin head welded to a spring pin unit in turn held by riveting said spring pin unit to said extension leg;

f) a threaded screw bolt held to said ladder receiving sleeve by a piece of spot welded wire;

g) a base load bar at the bottom of said ladder receiving sleeve;

h) holes in said ladder receiving sleeve for receipt of screws to hold a ladder leg with bolts internally mounted within said ladder receiving sleeve's said internal compartment;

i) holes in the said extension leg for receipt of said spring pin head from within and said threaded screw bolt from without;

j) holes in the lateral side of the said ladder receiving sleeve for receipt of said threaded screw bolt from without and said spring pin head from within when said extension leg is in situ within said external compartment of said ladder receiving sleeve during use of this device for leveling a ladder;

k) wire spot welded to said bolt nut apparatus and to the bottom of said base load bar.

2. Means for leveling a ladder having a pair of side rails comprising:

a) a receiving sleeve divided into two compartment by one continuous first wall, one of the ladder's legs mounted within one of said two compartments and attached thereto, and:

b) an extension leg adjustably mounted within the other of said two compartment to lengthen one side of the ladder, and c) a spring-pin unit consisting of a spring riveted at one end to said extension leg, a pin head welded to the other end of said spring for insertion into a one of a plurality of holes formed in a second wall of said other of said two compartments, a nut attached to said extension leg above said spring-pin unit, and;

d) a threaded screw inserted through a second hole of said second wall adjacent to said one hole and received within said nut, for securing purposes.

* * * * *